US009556578B1

(12) United States Patent
LaMora, Jr.

(10) Patent No.: US 9,556,578 B1
(45) Date of Patent: Jan. 31, 2017

(54) ADJUSTABLE DEBRIS COLLECTION APPARATUS FOR MARITIME VESSELS AND ASSOCIATED METHODS

(71) Applicant: Marine Environmental Remediation Group, LLC

(72) Inventor: Clarence F. LaMora, Jr., Liverpool, PA (US)

(73) Assignee: Marine Environmental Remediation Group, LLC

( * ) Notice: Subject to any disclaimer, the term of this patent is extended or adjusted under 35 U.S.C. 154(b) by 0 days.

(21) Appl. No.: 15/099,843

(22) Filed: Apr. 15, 2016

(51) Int. Cl.
*B63B 35/32* (2006.01)
*E02B 15/10* (2006.01)
*E02B 15/08* (2006.01)

(52) U.S. Cl.
CPC ..... *E02B 15/10* (2013.01); *B63B 35/32* (2013.01); *E02B 15/085* (2013.01)

(58) Field of Classification Search
CPC ..... E02B 15/10; E04G 21/3261
See application file for complete search history.

(56) References Cited

U.S. PATENT DOCUMENTS 2,517,978 A * 8/1950 Millard-Collier ..... B63B 35/08 114/240 R
5,299,654 A * 4/1994 Duncan ..... E04G 21/3261 182/138
5,743,208 A * 4/1998 Miller ..... B63B 17/02 114/361
6,637,364 B1 * 10/2003 Campeau ..... B63B 17/02 114/361
2001/0006037 A1 * 7/2001 Badley ..... B63B 35/816 114/253

* cited by examiner

*Primary Examiner* — Edwin Swinehart
(74) *Attorney, Agent, or Firm* — McCarter & English, LLP

(57) ABSTRACT

A debris collection apparatus for a maritime vessel includes a shroud and a plurality of support structures. Each of the plurality support structures include a boot defining a cavity and configured to be secured to the vessel, a foot sized to fit within the cavity and including a frame having a rotatably mounted first universal swivel, a staff cap including a staff cap terminal having a rotatably mounted second universal swivel rotatably, a stabilizer base configured to be secured to the vessel and including a body having a rotatably mounted third universal swivel, an elevational staff section removably connected to the first universal swivel and staff cap terminal, and a horizontal staff section removably connected to the second and third universal swivels. The foot is inserted into the boot to secure the support structures in a rigid position, and the shroud is connected to both staff caps and the vessel.

19 Claims, 17 Drawing Sheets

ADJUSTABLE DEBRIS COLLECTION APPARATUS FOR MARITIME VESSELS AND ASSOCIATED METHODS

FIELD OF THE PRESENT DISCLOSURE

Embodiments of the present disclosure generally relate to debris collection apparatuses for maritime vessels and associated methods, and, more specifically, to debris collection apparatuses that are adjustable and can be temporary installed on a maritime vessel for securing and containing debris and falling material during demolition and other activities.

BACKGROUND OF THE PRESENT DISCLOSURE

A variety of temporary structures have been utilized for years in an attempt to prevent debris and material from entering waterways and/or damaging adjacent marine structures during the demolition of maritime vessels. Exemplary temporary structures that have been utilized in the past include nets, cloth, wooden structures, and metal shields, which have all been variously employed on a case-by-case basis to prevent debris and materials from falling into adjacent water.

However, these structures are generally single use, "stick built" (e.g., they are a one time construction built to fit a specific structure that is being protected), difficult to erect and disassemble, utilize materials that cannot be safely reutilized once installed, and require an extensive amount of manpower and unrecoverable capital investment to create.

Despite the above-identified issues, there has been a lack of advancement in this field. This may be at least partially attributed to the wide variety of marine structures that are contemplated for protection. For example, buildings, bridges, ships, piers, wharfs, and quays, are all marine structures that are contemplated for protection, but each requires a different type of structural protection in order to provide acceptable results. While there are thousands of these marine structures in the world, there is little to no specialization in companies dedicated to the specific application of demolishing maritime vessels and a corresponding lack of effort to standardize protection structures to be used during the demolition of the maritime vessels, which amounts to a small but vital component of that work.

Due to the lack of uniformity between structures and a broad approach to completing a demolition project, with or without sensitivity to the underlying regulatory requirements, the known systems do not offer the flexibility and protection that is desired and/or required by both regulations and prudence on the part of the operator.

What is needed in the art is a debris collection apparatus for maritime vessels for securing and containing debris and falling material during demolition and other activities and that includes continuously stable support mechanisms, is movable and adjustable to protect different structures, can be quickly and easily erected and dismantled, and can be reused on the same vessel or other vessels. These and other needs are addressed by the adjustable debris collection apparatus of the present disclosure.

SUMMARY OF THE DISCLOSURE

Example embodiments of the present disclosure relate to debris collection apparatuses, support structures for debris collection apparatuses, methods of installing the support structures, and methods for installing the debris collection apparatus.

More particularly, in some embodiments of the present disclosure a debris collection apparatus includes a shroud for containing debris, and a plurality of support structures including at least a first support structure and a second support structure. For example, the first and the second support structures can include a boot, a foot having a first universal swivel, a staff cap having a second universal swivel, a stabilizer base having a third universal swivel, an elevational staff section, and a horizontal staff section. Continuing with this exemplary embodiment, the boot can define a cavity and is configured to be removably secured to a vessel for receiving the foot which is generally sized to fit within the cavity of the boot. The foot additionally includes the first universal swivel and a frame that the first universal swivel is rotationally mounted to. The foot can be connected to the staff cap by the elevational staff section, which connects to the first universal swivel of the foot, and a staff cap terminal of the staff cap. In this regard, the staff cap can include the second universal swivel and the staff cap terminal that the second universal swivel is mounted to. The stabilizer base is configured to be removably secured to the vessel and connected to the staff cap by the horizontal staff section, which connects to the second universal swivel of the staff cap and the third universal swivel of the stabilizer base. In this regard, the stabilizer base can include the third universal swivel and a body having the third universal swivel rotatably mounted thereto. The foot can be inserted into the boot to set the first and second support structures in a rigid position, and the shroud can be connected to the staff cap of the first support structure, the staff cap of the second support structure, and the vessel to collect debris. In some embodiments, the shroud can be one of a mesh net and a welding blanket, while in other aspects the shroud can include a tensioner cable that can be connected to the vessel and tightened to secure the shroud to the vessel.

In some aspects of the present disclosure, the plurality of support structures can include a third support structure having a staff cap, and the shroud can be further connected to the staff cap of the third support structure.

In other aspects of the present disclosure, the elevational staff section can include at least two staffs connected by at least one staff union, and the horizontal staff section can include at least two staffs connected by at least one staff union.

In still other aspects of the present disclosure, the foot can include a stop pin that restricts rotation of the first universal swivel, the staff cap terminal can restrict rotation of the second universal swivel, and/or the body of the stabilizer base can restrict rotation of the third universal swivel.

In additional aspects of the present disclosure, the boot can be secured to a side of the vessel and the stabilizer base can be secured to a deck of the vessel.

In some aspects of the present disclose, the elevational staff section of the debris collection apparatus can be removably connected to the first universal swivel and the staff cap terminal by removable pins, and the horizontal staff section can be removably connected to the second universal swivel and the third universal swivel by removable pins. In this exemplary configuration, the first and second support structures can be deconstructed by removing the foot from the boot, removing the removable pins, and disconnecting the first universal swivel of the foot, the elevational staff section, the second universal swivel of the staff cap, the horizontal staff section, and the third universal swivel of the stabilizer base.

In accordance with embodiments of the present disclosure, a portable support structure kit for a debris collection apparatus used to collect debris during demolition of a maritime vessel is provided. The portable support structure kit can include a boot, a foot having a first universal swivel, a staff cap having a second universal swivel, a stabilizer base having a third universal swivel, an elevational staff section, and a horizontal staff section. Continuing with this exemplary embodiment, the boot can define a cavity and is removably securable to a vessel for receiving the foot which is generally sized to fit within the cavity of the boot. The foot additionally includes the first universal swivel and a frame that the first universal swivel is rotatably mountable to. The foot is connectable to the staff cap by the elevational staff section, which is connectable to the first universal swivel of the foot, and a staff cap terminal of the staff cap. In this regard, the staff cap can include the second universal swivel and the staff cap terminal that the second universal swivel is mountable to. The stabilizer base is removably securable to the vessel and connectable to the staff cap by the horizontal staff section, which is connectable to the second universal swivel of the staff cap and the third universal swivel of the stabilizer base. In this regard, the stabilizer base can include the third universal swivel and a body having the third universal swivel rotatably mountable thereto. The foot is insertable into the boot to set the first and second support structures in a rigid position, and the shroud is connectable to the staff cap of the first support structure, the staff cap of the second support structure, and the vessel to collect debris.

In accordance with embodiments of the present disclosure, a method of installing a support structure on a vessel is provided. In this exemplary method, a boot that defines a cavity is first secured to the vessel. An elevational staff section is then removably connected to a foot by removably engaging the elevational staff section with a first universal swivel of the foot. The foot includes a frame having the first universal swivel mounted thereto, and is generally sized to fit within the cavity of the boot. The elevational staff section is then removably connected to a staff cap by removably engaging the elevational staff section with a staff cap terminal. The staff cap can further include a second universal swivel rotatably mounted to the staff cap terminal. A horizontal staff section is then removably connected to the staff cap by removably engaging the horizontal staff section with the second universal swivel of the staff cap. Next, a stabilizer base is removably secured to the vessel. The stabilizer base can include a body and a third universal swivel rotatably mounted to the body. The horizontal staff section can then be removably connected to the third universal swivel of the stabilizer base. Finally, the foot can be inserted into the boot to rigidly secure the support structure.

Additional features, functions and benefits of the disclosed debris collection apparatuses, support structures for debris collection apparatuses, methods of installing the support structures, and methods for installing the debris collection apparatuses will be apparent from the detailed description which follows, particularly when read in conjunction with the accompanying figures.

BRIEF DESCRIPTION OF THE DRAWINGS

For a more complete understanding of the present disclosure, reference is made to the following detailed description of an exemplary embodiment considered in conjunction with the accompanying drawings, in which.

DETAILED DESCRIPTION OF THE PRESENT DISCLOSURE

Embodiments of the present disclosure generally relate to debris collection apparatuses for maritime vessels and associated methods, and, more specifically, to debris collection apparatuses that are adjustable and can be temporarily installed on a maritime vessel for securing and containing debris and falling material during demolition and other activities.

Figure 1:
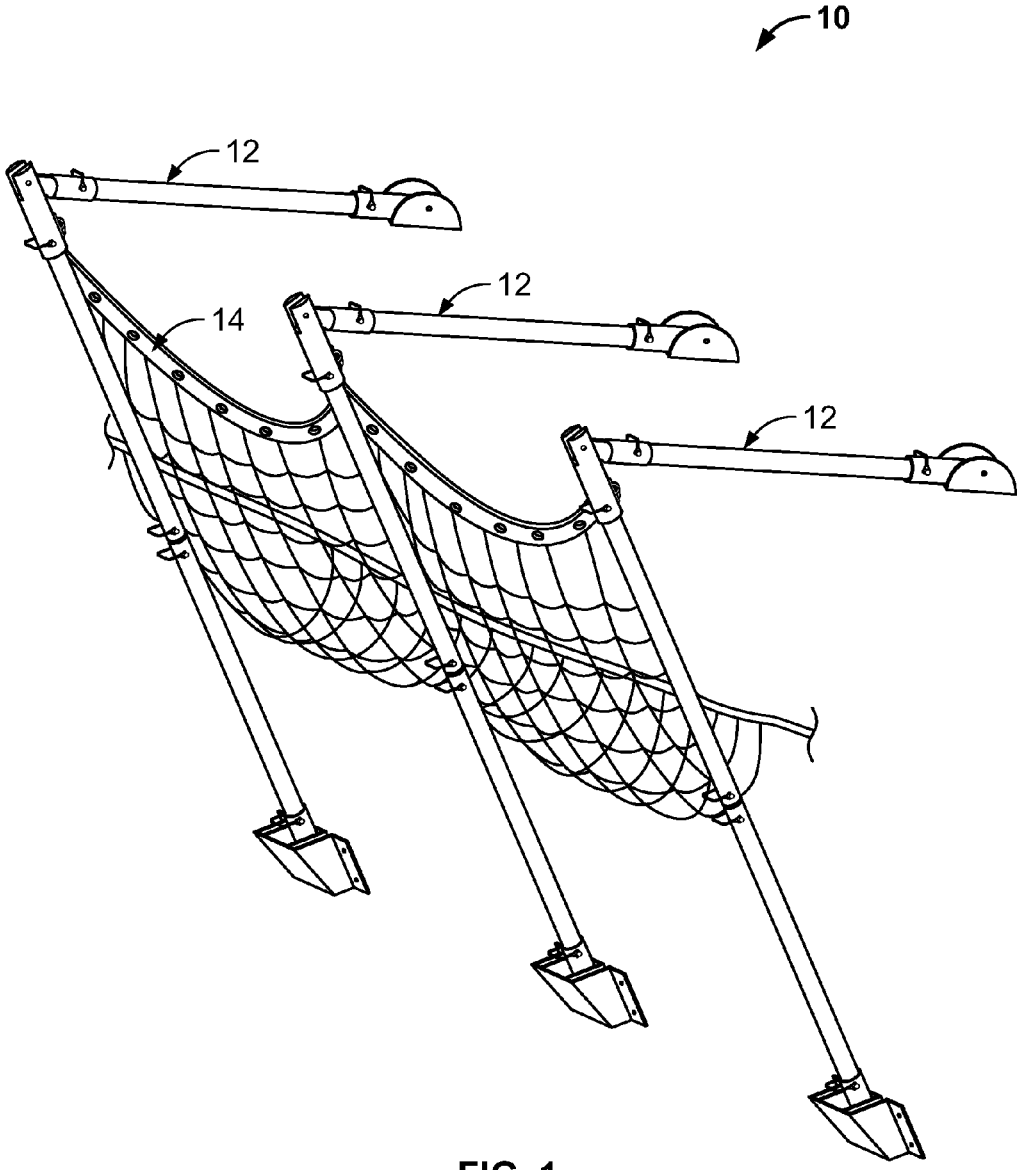
FIG. 1 is a perspective view of the debris collection apparatus of the present disclosure.

FIG. 1 is a perspective view of a debris collection apparatus 10 for installation on a maritime vessel, e.g., a ship or boat, to be demolished. The debris collection apparatus 10 includes a plurality of semi-rigid support structures 12 and a shroud 14 connected to each of the support structures 12. The support structures 12 are configured to be removably installed on a maritime vessel, while the shroud 14 is removably connected to the support structures 12 and configured to catch any debris or material that may fall from the maritime vessel, thus preventing such debris and/or material from falling into any adjacent waterways or onto any adjacent marine structures, e.g., docks, piers, wharfs, etc., and damaging them. The functionality and components of the debris collection apparatus 10 is described in greater detail below.

Figure 2:
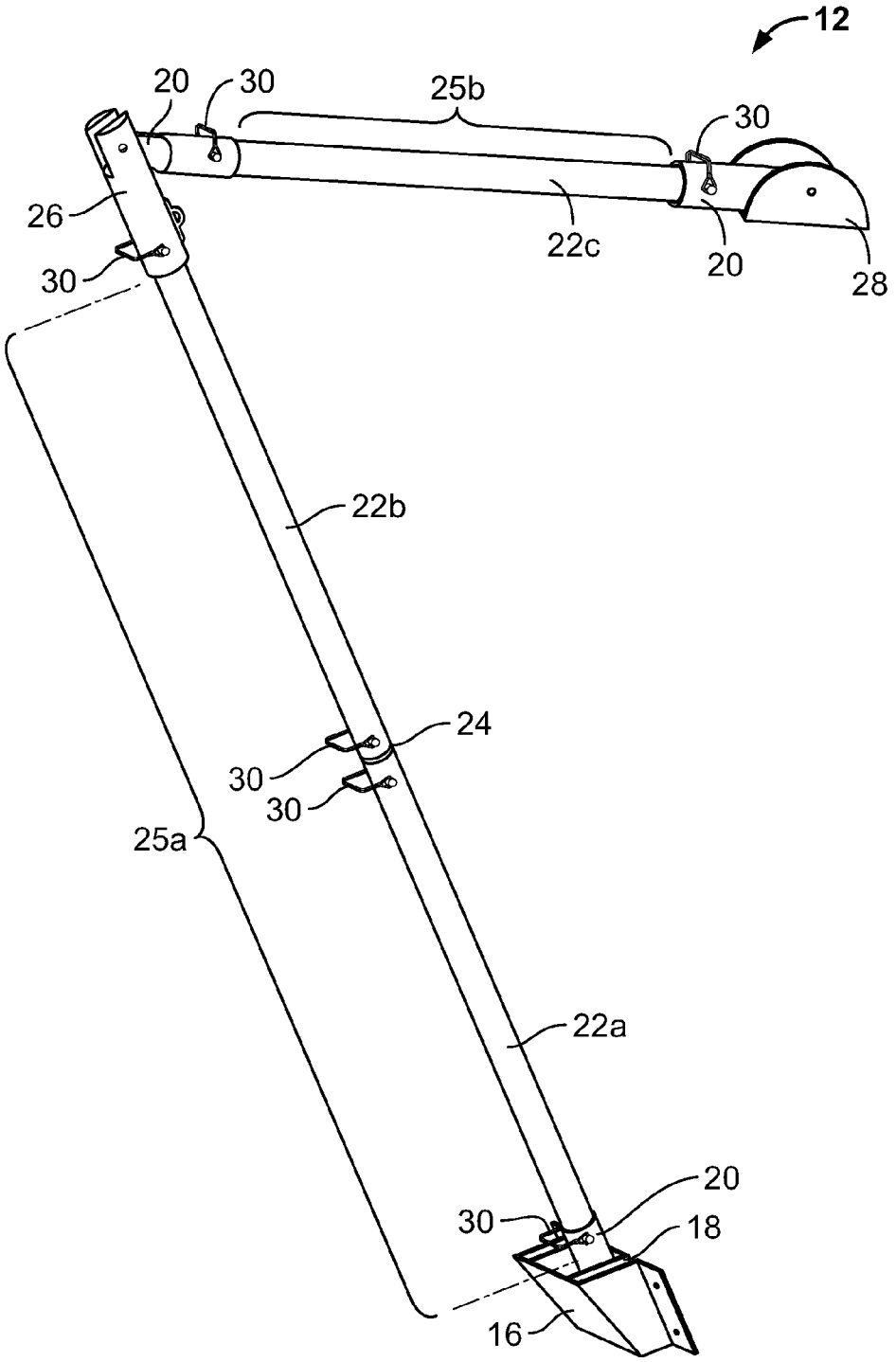
FIG. 2 is a perspective view of a support structure of the debris collection apparatus of FIG. 1.
Figure 3:
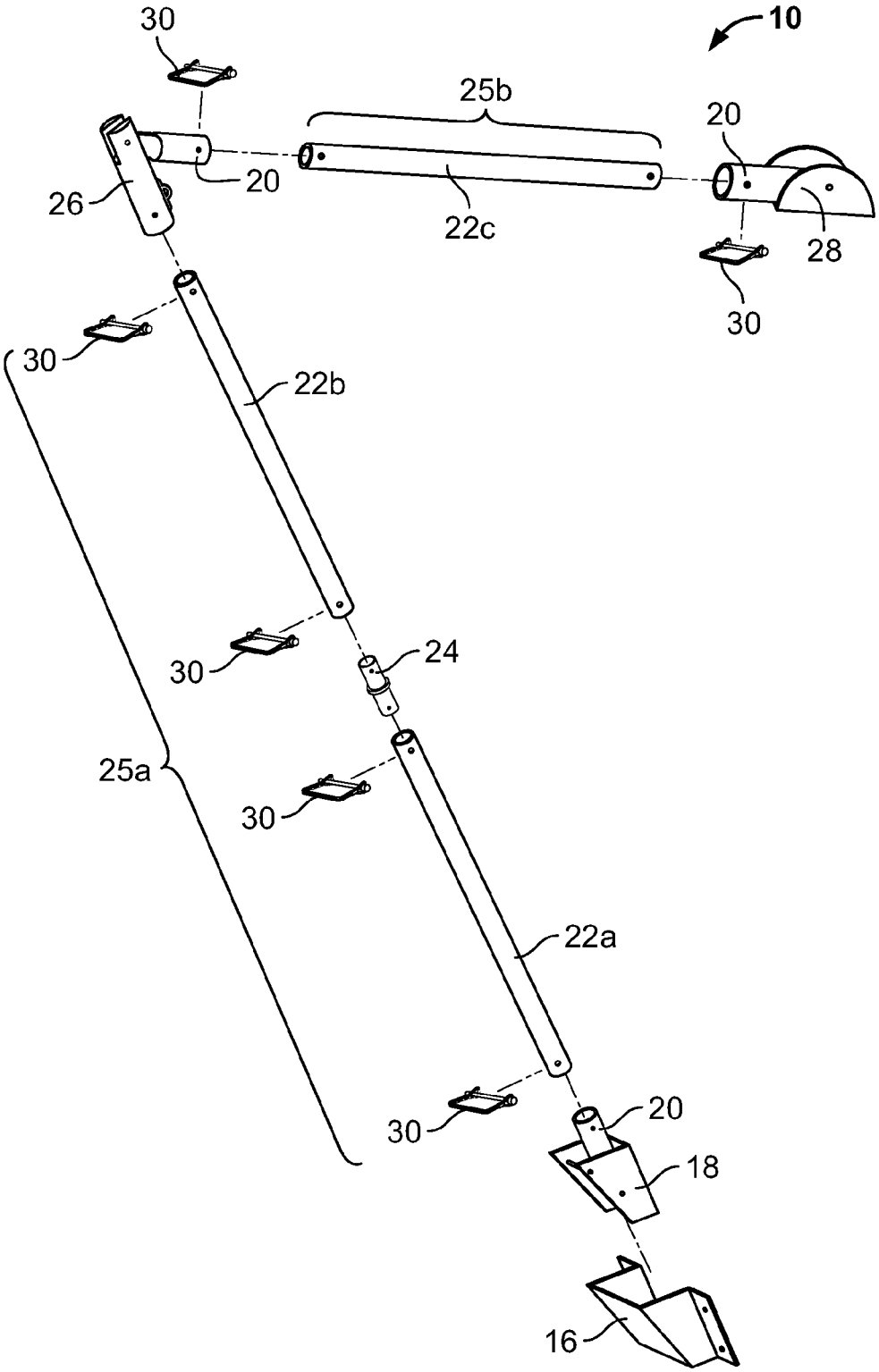
FIG. 3 is an exploded perspective view of the support structure of FIG. 2.
Figure 4A:
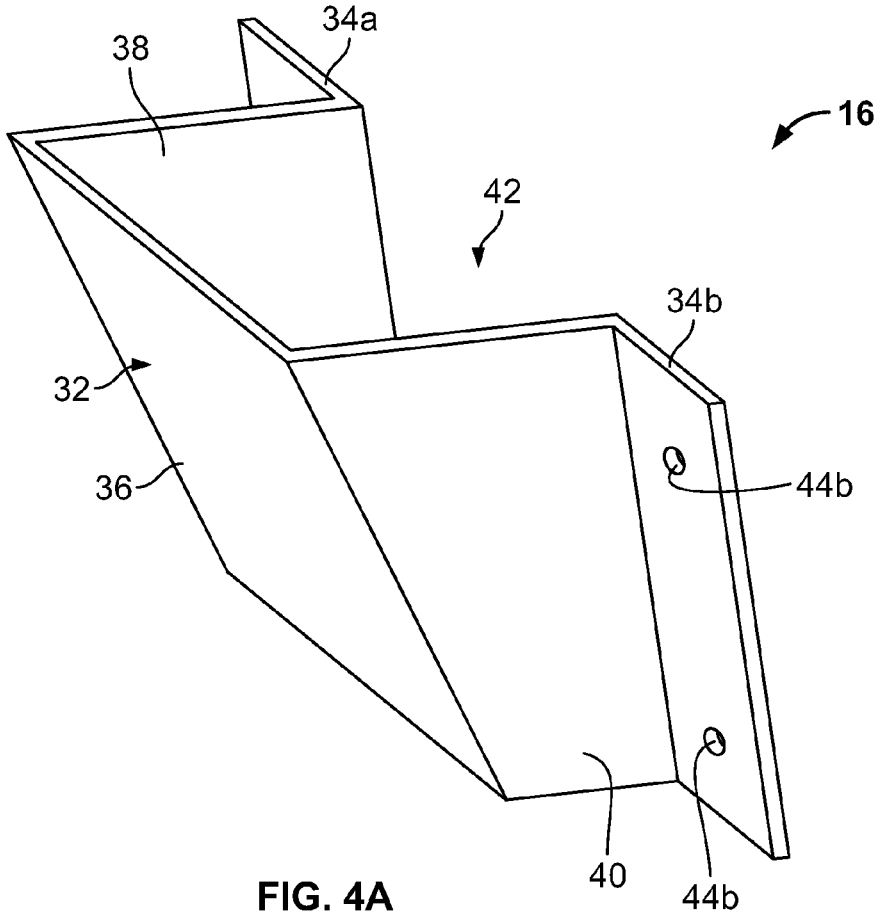
FIG. 4A is a perspective view of a boot of the support structure of FIGS. 2 and 3.
Figure 4B:
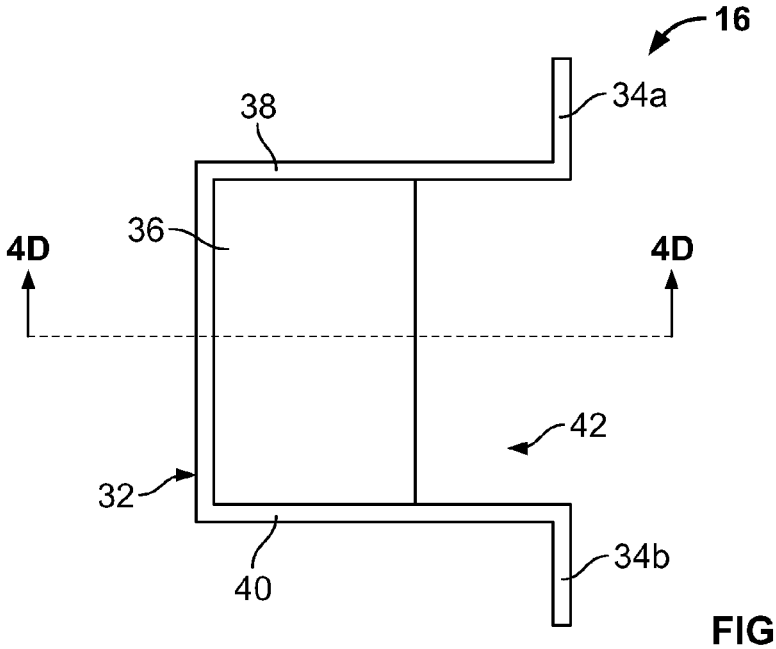
FIG. 4B is a top view of the boot of FIG. 4A.
Figure 4C:
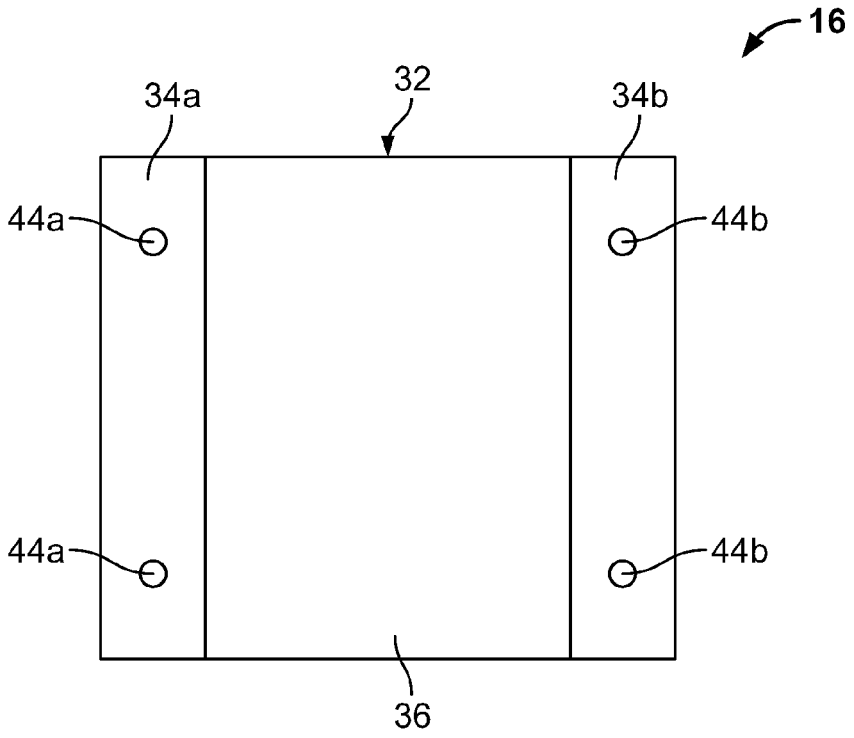
FIG. 4C is a rear view of the boot of FIG. 4A.
Figure 4D:
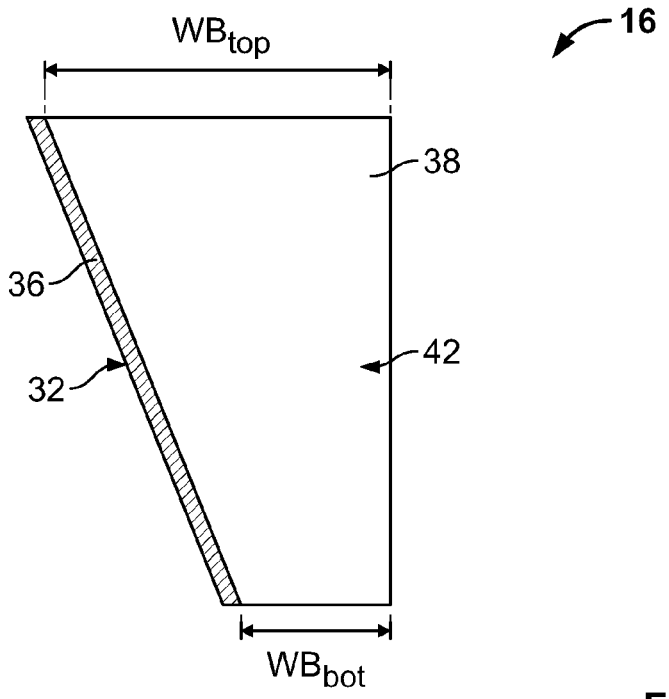
FIG. 4D is a sectional view of the boot of FIG. 4A taken along line 4D-4D of FIG. 4B.
Figure 5A:
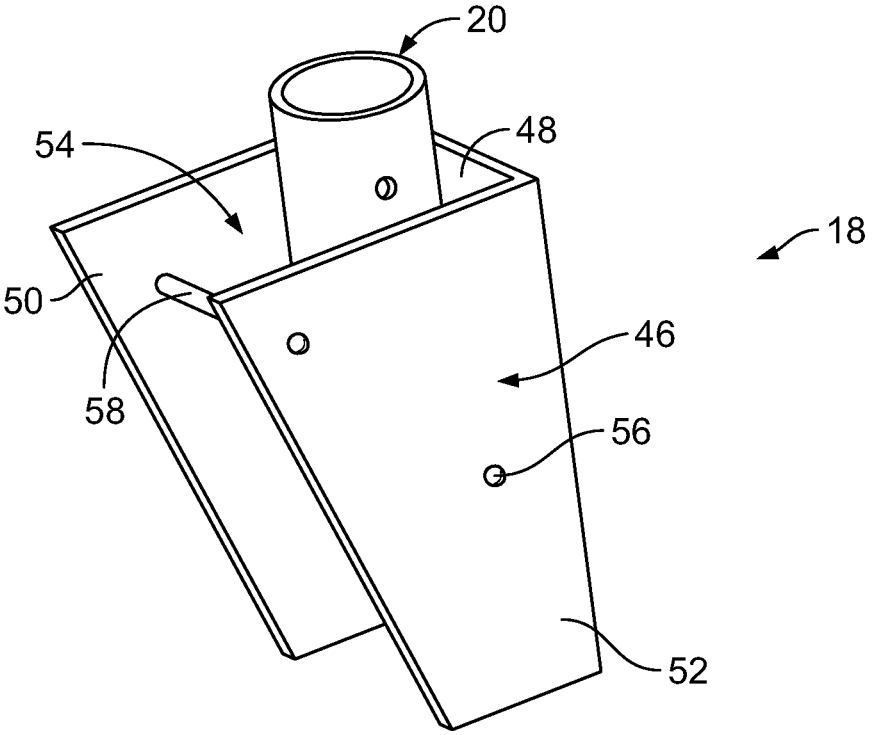
FIG. 5A is a perspective view of a foot including a universal swivel of the support structure of FIGS. 2 and 3.
Figure 5B:
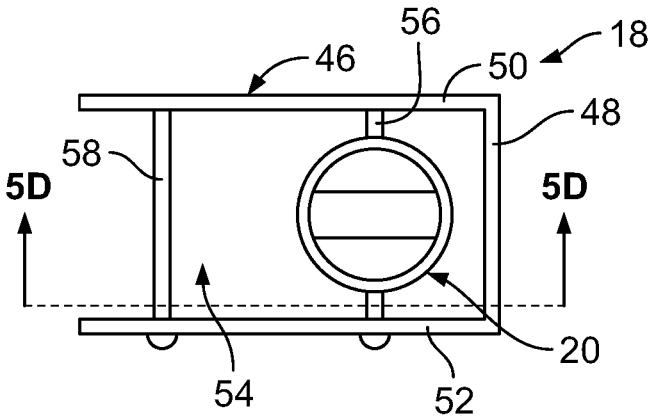
FIG. 5B is a top view of the foot including universal swivel of FIG. 5A.
Figure 5C:
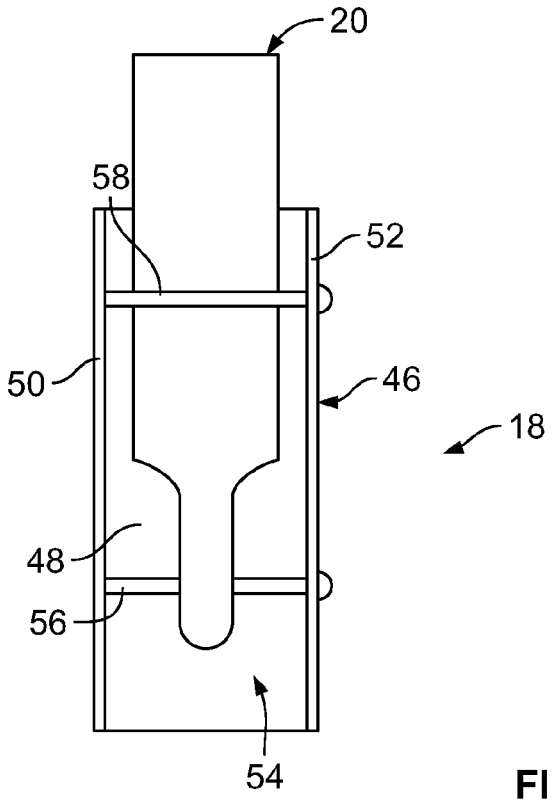
FIG. 5C is a rear view of the foot including universal swivel of FIG. 5A.
Figure 5D:
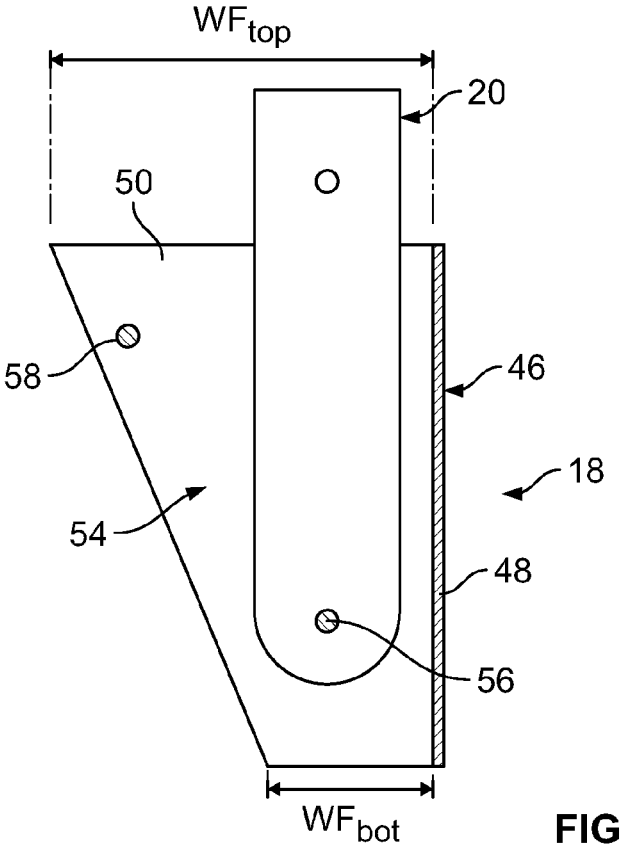
FIG. 5D is a sectional view of the foot including universal swivel of FIG. 5A taken along line 5D-5D of FIG. 5B.

FIGS. 2 and 3 show a single support structure 12 of the debris collection apparatus 10 in greater detail. FIG. 2 is a perspective view of the support structure 12 shown in FIG. 1, while FIG. 3 is an exploded perspective view of the support structure 12 shown in FIG. 2. The support structure 12 includes a boot 16, a foot 18 including a universal swivel 20, a plurality of rigid staffs 22*a*, 22*b*, 22*c*, a staff union 24, a staff cap 26 including a universal swivel 20, a stabilizer base 28 including a universal swivel 20, and a plurality of pins 30 interconnecting the various components.

The boot 16 is generally a support structure that is configured to be connected with the side of a maritime vessel (e.g., a boat or a ship) and is configured to receive the foot 18, which is inserted into the boot 16 to provide for vertical installation of the support structure 12. A universal swivel 20 is rotational engaged with the foot 18 to permit limited rotation, and is connected with a first staff 22*a*. The first staff 22*a* is connected with the staff union 24, which is in turn connected with the second staff 22*b*. Accordingly, the staff union 24 interconnects the first staff 22*a* and the second staff 22*b*. It should be understood that more than two staffs 22*a*, 22*b* and more than one staff union 24 can implemented if desired. For example, third, fourth, or fifth staffs can be connected in series with the first and second staffs 22*a*, 22*b* by additional staff unions 24 to create a longer vertical section. This process can be repeated and staffs can be added until the desired length is reached where the final staff is capped with a staff cap 26. In the illustrated example of FIGS. 1-3, the staff cap 26 is connected to the second staff 22*b*. A universal swivel 20 is rotational engaged with the staff cap 26 and connected with the third staff 22*c*, which is in turn connected with another universal swivel 20 that is rotational engaged with the stabilizer base 28. The stabilizer base 28 can be removably mounted to a vessel deck and provides for removable attachment of the support structure 12 to the deck. It should be understood that each of the above-described components are removably attached to one another such that the support structure 12 can be easily deconstructed and moved, e.g., to another location on the same boat or to a different maritime vessel, or so that the support structure 12 can be easily expanded, e.g., additional staffs can be added.

Additionally, as shown in FIGS. 2 and 3, the first staff 22*a*, staff union 24, and second staff 22*b* generally form an elevational staff section 25*a*, while the third staff 22C generally forms a horizontal staff section 25*b*. It should be understood that the elevational staff section 25*a* and the horizontal staff section 25*b* can respectively include a single staff, or a plurality of staffs connected by one or more staff unions. For example, while the elevational staff section 25*a* is shown with two staffs and one staff union, it can alternatively comprise a single staff and no staff union, or can have three staffs and two staff unions, etc. Similarly, while the horizontal staff section 25*b* is shown with a single staff and no staff union, it can alternatively comprise two staffs and one staff union, etc. This functionality permits the elevational and horizontal staff sections 25*a*, 25*b* to be increased or decreased in length based on the vessel that the debris collection apparatus 10 is installed on.

Turning now to the details of each individual component, FIGS. 4A-4D show the boot 16 in greater detail. The boot 16 generally includes an angled body 32 connected with first and second flanges 34*a*, 34*b*. The angled body 32 includes a back 36, a first side 38, and a second side 40 (opposite the first side 38), which define a cavity 42. The first and second sides 38, 40 generally taper inward, e.g., reduce in width, from a top width, $WB_{top}$, to a bottom width, $WB_{bot}$. The tapered geometry of the first and second sides 38, 40 causes the cavity 42 to also be tapered (see, e.g., FIG. 4D, which is a sectional view of FIG. 4B taken along line 4D-4D). The angled body 32 is connected with the first and second flanges 34*a*, 34*b*, which each have a pair of holes 44*a*, 44*b* extending therethrough (see, e.g., FIG. 4C). The holes 44*a*, 44*b* can be ¼" diameter and facilitate attachment of the boot 16 to the side of a vessel with appropriately sized fasteners, e.g., bolts. The body 32 of the boot 16 is generally formed with a shape and size that substantially matches the shape and size of the foot 18 to permit insertion of the foot 18 into the cavity 42 and secured in place by the body 32 and the side of the vessel that the boot 16 is attached to. The boot 16 can be constructed of mild steel that is cold rolled and hot forged. The boot 16 can also be created from a single sheet of metal, which could be of ⅛" thickness, and formed by cold bending at four corners. It should be understood that any other suitable material could be utilized and any other suitable metal forming techniques can be implemented to create the boot 16.

FIGS. 5A-5D show the foot 18 in greater detail. The foot 18 generally includes an angled frame 46 and a universal swivel 20. The angled frame 46 includes a back 48, a first side 50, and a second side 52 (opposite the first side 50), which define a cavity 54. The first and second sides 50, 52 generally taper inward, e.g., reduce in width, from a top width, $WF_{top}$, to a bottom width, $WF_{bot}$, in a similar fashion to the body 32 of the boot 16. The tapered geometry of the first and second sides 50, 52 causes the cavity 54 to also be tapered (see, e.g., FIG. 5D, which is a sectional view of FIG. 5B taken along line 5D-5D). Accordingly, the frame 46 of the foot 18 is generally formed with a shape and size that substantially matches the shape and size of the boot 16 so that the foot 18 can be inserted into the cavity 42 of the boot 16 and can engage the boot 16 in a mating relationship. More specifically, the bottom width, $WF_{bot}$ of the foot 18 is less than the top width $WB_{top}$ of the boot 16 so that the foot 18 can be inserted into the boot 16. When inserted into the boot 16, the foot 18 is positioned within the cavity 42 with the back 48 of the frame 46 adjacent the side of the vessel that the boot 16 is attached to. The foot 18 can be constructed of mild steel that is cold rolled and hot forged. The foot 18 can also be created from a single sheet of metal, which could be of ⅛" thickness, and formed by cold bending at two corners to form the cavity 54. It should be understood that any other suitable material could be utilized and any other suitable metal forming techniques can be implemented to create the foot 18. The universal swivel 20 is inserted into and positioned within the cavity 54 of the foot 18, and connected to the foot 18 with a swivel pin 56. Particularly, the swivel pin 56 extends from the first side 50 to the second side 52 and through a portion of the universal swivel 20 (discussed in greater detail below) so that the universal swivel 20 can rotate about the swivel pin 56. The foot 18 additionally includes a stop pin 58 that extends from the first side 50 to the second side 52. The stop pin 56 is generally positioned at the wider end of the first and second sides 50, 52, e.g., the end having the top width $WB_{top}$, and at a position so that the swivel pin 56 is between the stop pin 58 and the back 48 of the foot 18. Accordingly, the stop pin 58 is configured so as to prevent or limit rotation of the universal swivel 20 beyond a certain point. The stop pin 58 can also include an outer coating or sheath that can prevent the universal swivel from being damaged. The swivel pin 56 and the stop pin 58 can be class "eight" pins, or any other suitable pin.

Figure 6A:
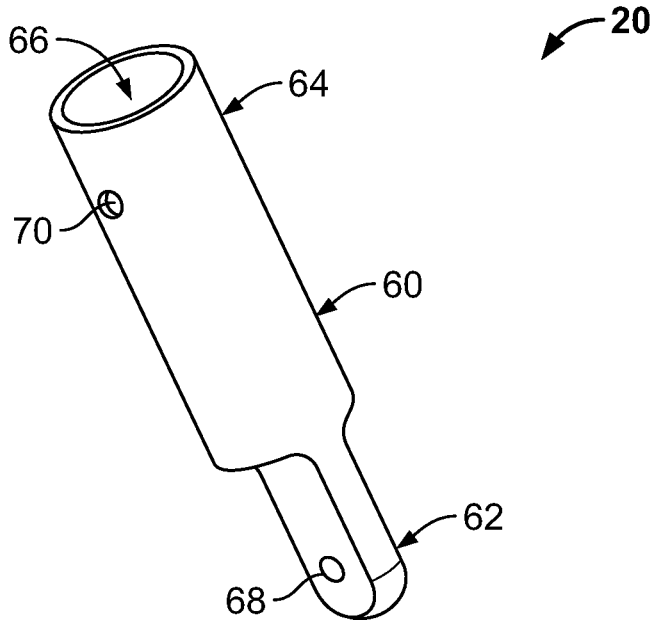
FIG. 6A is a perspective of the universal swivel of the support structure of FIGS. 2 and 3.
Figure 6B:
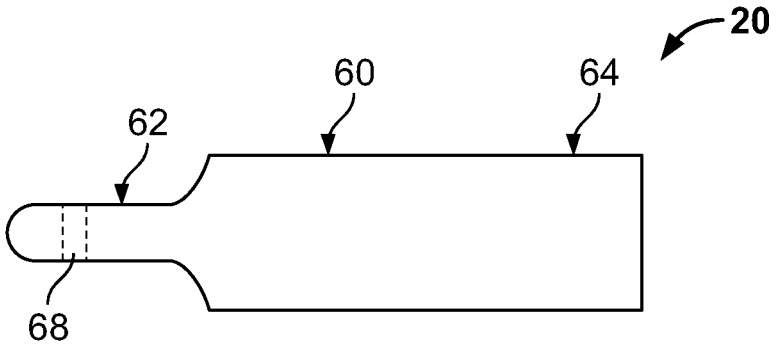
FIG. 6B is a rear view of the universal swivel of FIG. 6A.
Figure 6C:
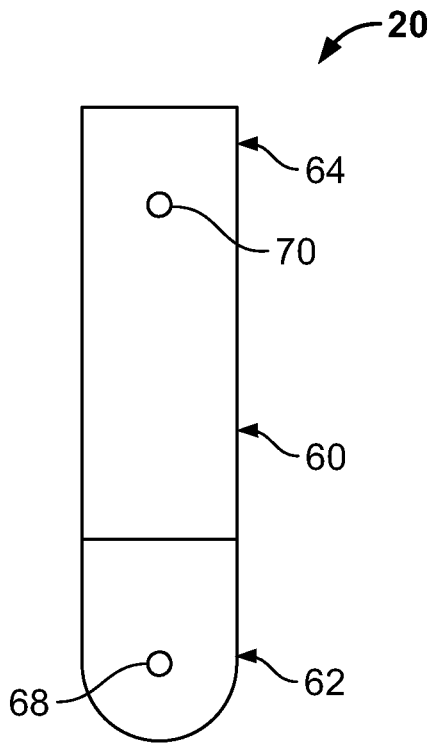
FIG. 6C is a side view of the universal swivel of FIG. 6A.

FIGS. 6A-6C show the universal swivel 20 in greater detail. The universal swivel 20 generally includes a body 60 having a connecting rod 62 connected to a head 64. The head 64 is generally circular in shape and is hollow defining an internal chamber 66, whereas the connecting rod 62 is generally solid and of a reduced width compared to the head 64. This configuration allows for components to be inserted into the internal chamber 66 of the head 64, while the connecting rod 62 can be inserted into smaller openings or cavities. Furthermore, the connecting rod 62 includes a pre-drilled hole 68 extending therethrough, while the head 64 includes a similar pre-drilled hole 70 extending through the entirety thereof. The hole 68 of the connecting rod 62 permits insertion of, for example, the swivel pin 56, discussed above in connection with FIGS. 5A-5D. Accordingly, the hole 68 permits the universal swivel 20 to be rotationally mounted to various components, e.g., the foot 18. The hole 70 of the head 64 permits insertion of, for example, the pin 30, which could be a Curt Safety Pin™, or any other similar commercially available pin. In a situation where a component, e.g., the first staff 22*a*, is positioned in the internal chamber 66 of the head 64, the two components can be connected by the pin 30 extending through the hole 68 and through similarly sized pre-drilled holes extending through the first staff 22*a*, discussed in detail below.

Figure 7A:
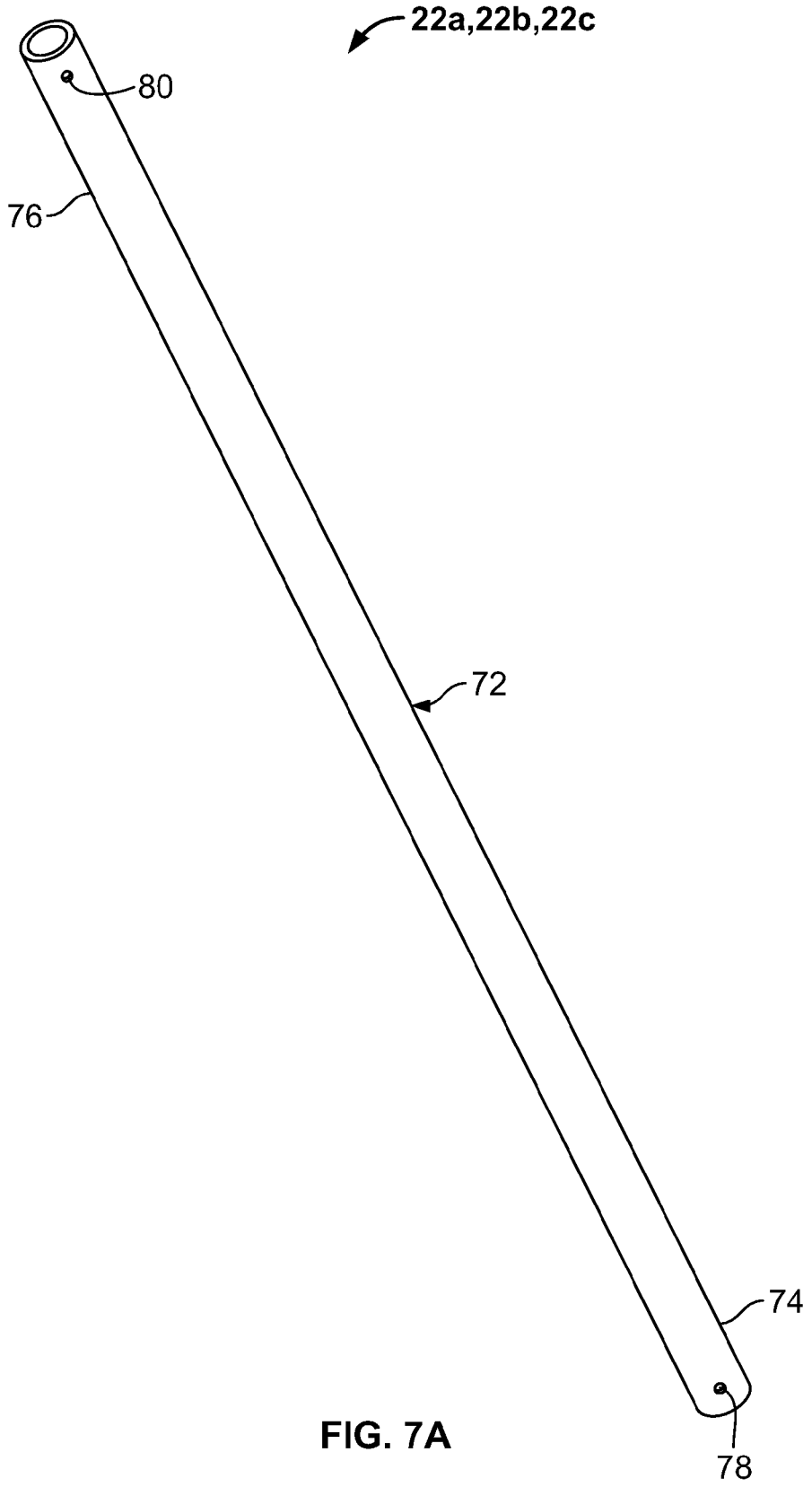
FIG. 7A is a perspective view of a staff of the support structure of FIGS. 2 and 3.
Figure 7B:
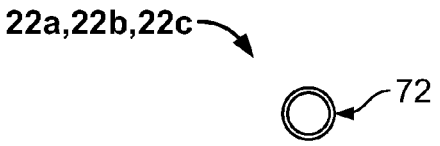
FIG. 7B is a top view of the staff of FIG. 7A.
Figure 7C:
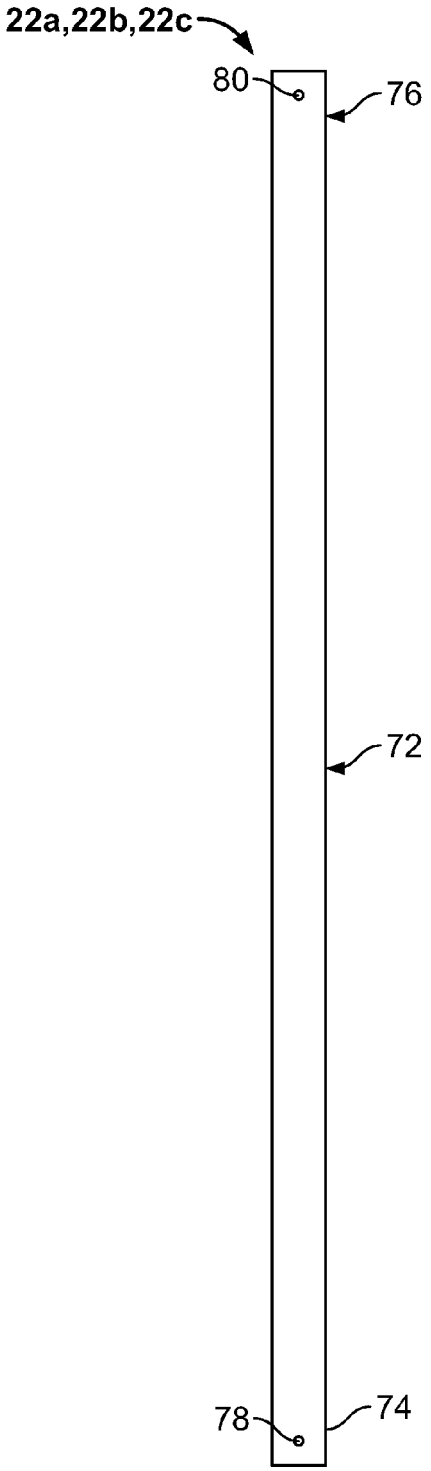
FIG. 7C is a side view of the staff of FIG. 7A.
Figure 8A:
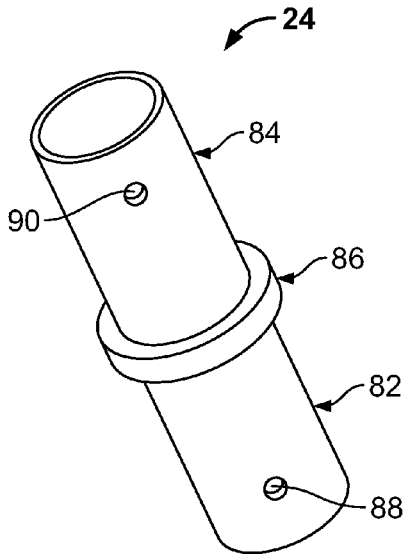
FIG. 8A is a perspective view of a staff union of the support structure of FIGS. 2 and 3.
Figure 8B:
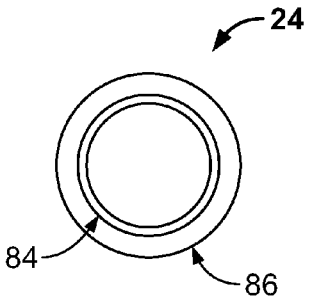
FIG. 8B is a top view of the staff union of FIG. 8A.
Figure 8C:
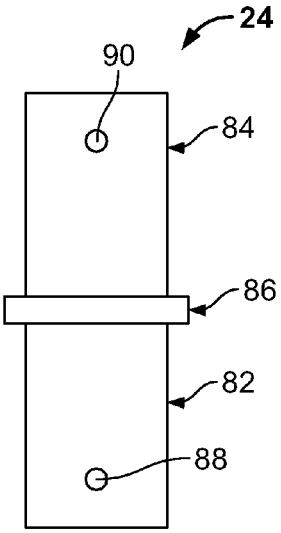
FIG. 8C is a rear view of the staff union of FIG. 8A.
Figure 8D:
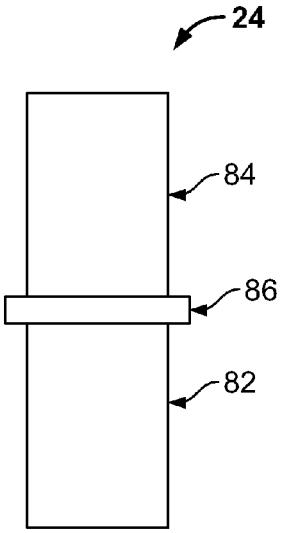
FIG. 8D is a side view of the staff union of FIG. 8A.
Figure 9A:
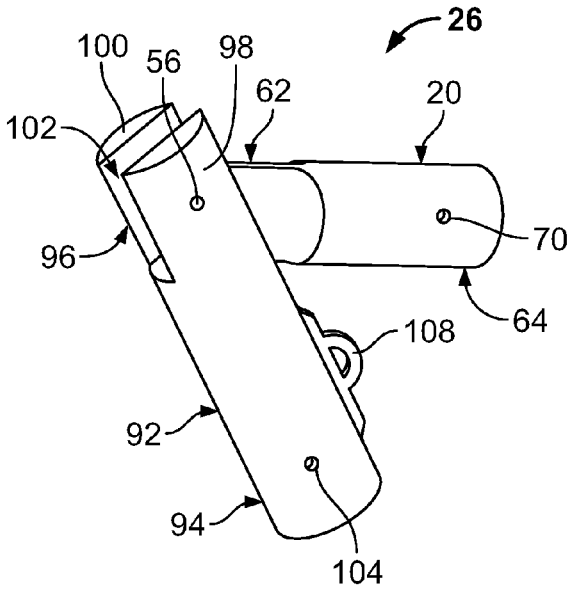
FIG. 9A is a perspective view of a staff cap including a universal swivel of the support structure of FIGS. 2 and 3.
Figure 9B:
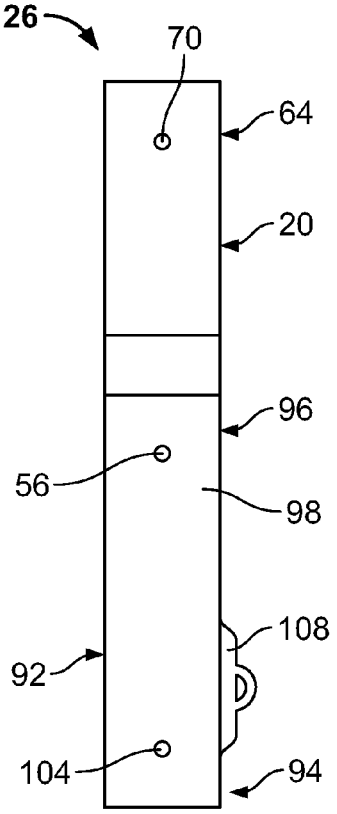
FIG. 9B is a rear view of the cap including universal swivel of FIG. 9A.
Figure 9C:
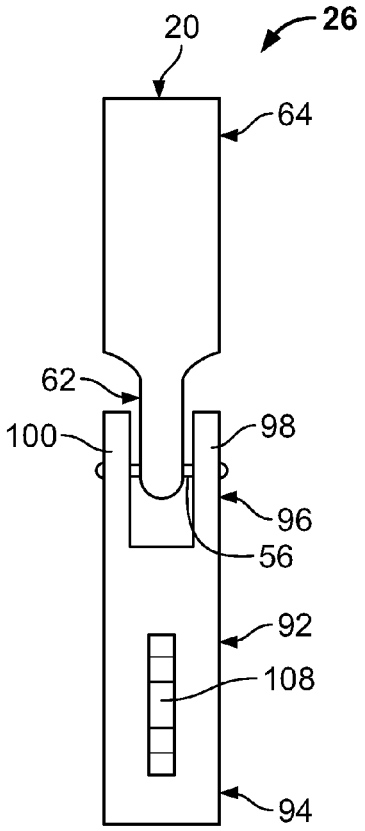
FIG. 9C is a side view of the cap including universal swivel of FIG. 9A.
Figure 10A:
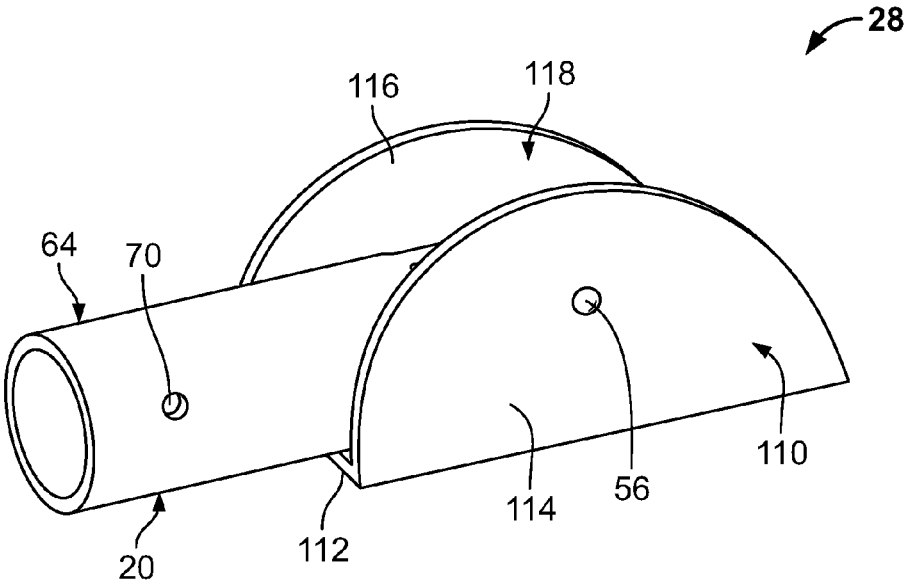
FIG. 10A is a perspective view of a stabilizer base including a universal swivel of the support structure of FIGS. 2 and 3.
Figure 10B:
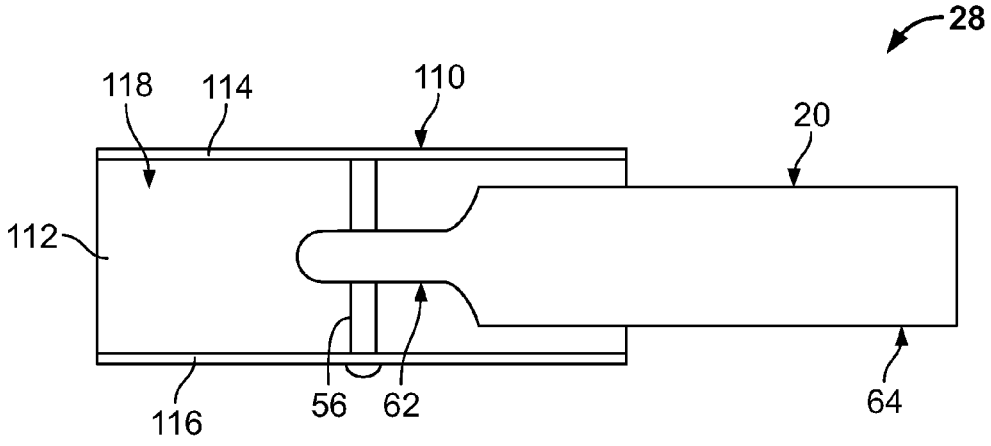
FIG. 10B is a top view of the stabilizer base including universal swivel of FIG. 10A.
Figure 10C:
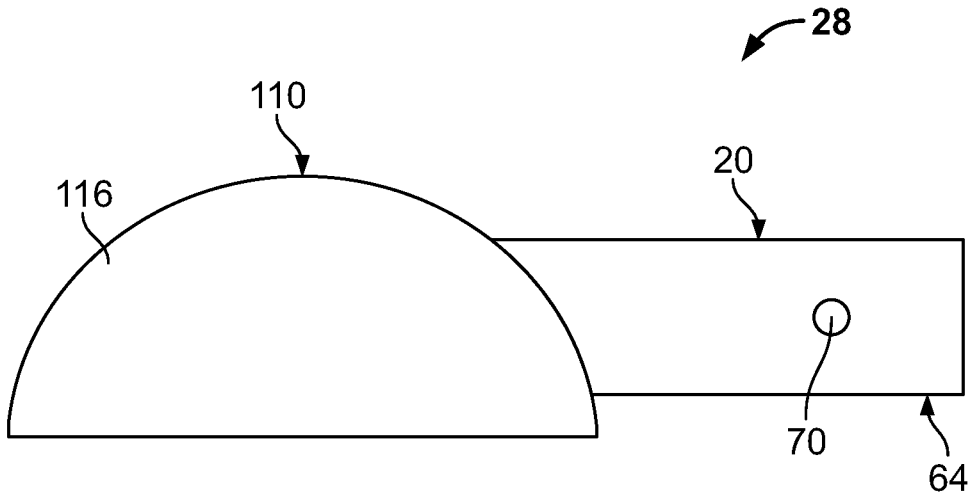
FIG. 10C is a side view of the stabilizer base including universal swivel of FIG. 10A.
Figure 10D:
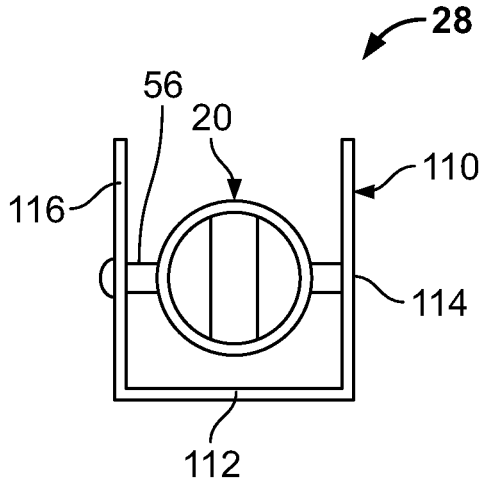
FIG. 10D is a rear view of the stabilizer base including universal swivel of FIG. 10A.

FIGS. 7A-7C show the first, second, and third staffs 22*a*, 22*b*, 22*c* in greater detail. It should be understood that the first, second, and third staffs 22*a*, 22*b*, 22*c* are identical in construction and the description made herein with respect to the first staff 22*a* holds true for the second and third staffs 22*b*, 22*c* as well. Furthermore, while only three staffs are referenced, it should be understood that the present disclosure includes as many staffs as necessary to create an appropriately sized support structure 12 for the task that it is being implemented for. The first staff 22*a* includes a body 72 that is generally tubular in shape has a first end 74 and a second end 76. The first and second ends 74, 76 each respectively include a hole 78, 80 extending through each opposing side of the first staff 22*a*. The holes 78, 80 can be ¼" in diameter. The first staff 22*a* is sized to be inserted into the head 64 of the universal swivel 20. Additionally, the holes 78, 80 are sized and positioned to match the hole 70 of the universal swivel 20 so that a pin 30 can be inserted through the hole 78 (or the hole 80, depending on orientation), and the hole 70 when the first staff 22*a* is inserted into the head 64 of the universal swivel 20 and the hole 78 (or the hole 80, depending on orientation) is aligned with the hole 70, thus removably connecting the first staff 22*a* with the universal swivel 20. Accordingly, when connected with the universal swivel 20, the first staff 22*a* can rotate with the universal swivel 20 about the swivel pin 56. The first staff 22*a* can also be connected with the staff union 24, discussed in greater detail below. The staffs 22*a*, 22*b*, 22*c* can be constructed of mild steel, cold rolled, hot forged, and formed by constant circular extrusion. In some embodiments, the staffs 22*a*, 22*b*, 22*c* can have an outside diameter of 1 15/16" and an inside diameter of 1¾", with ends severed perpendicular to the longitudinal axis of the staff.

FIGS. 8A-8D show the staff union 24 in greater detail. The staff union 24 is a generally tubular component that includes a first end 82, a second end 84, and an annular staff stop 86 positioned intermediate the first and second ends 82, 84 and having a greater diameter than the first and second ends 82, 84. The first and second ends 82, 84 also each include a hole 88, 90, respectively. The hole 88 extends entirely through the first end 82, e.g., through each opposing side, while the hole 90 extends entirely through the second end 84, e.g., through each opposing side. The holes 88, 90 can be ¼" in diameter. The first and second ends 82, 84 are sized in shape and diameter to be inserted into the first end 74 or the second end 76 of any one of the staffs 22*a*, 22*b*, 22*c*, while the annular staff stop 86 is generally sized to be larger than the inner diameter of the staffs 22*a*, 22*b*, 22*c*. For example, in a first aspect the first and second ends 82, 84 can have a 1 11/16" outside diameter and the annular staff stop 86 can have 2" diameter. When, for example, the first end 82 of the staff union 24 is inserted into the second end 76 of the first staff 22*a*, the annular staff stop 86 prevents the staff union 24 from sliding entirely into the first staff 22*a* by engaging an end face of the first staff 22*a*. The staff union 24 can then be connected with the first staff 22*a* by aligning the hole 88 of the staff union 24 with the hole 80 of the first staff 22*a* and inserting a pin 30 through the aligned holes 80, 88, thus releasably connecting the staff union 24 with the first staff 22*a*. The staff union 24 can then be connected to the second staff 22*b* by inserting the second end 84 into the second staff 22*b*, aligning the hole 88 of the staff union 24 with the hole 78 of the second staff 22*b* and inserting a pin 30 through the aligned holes 78, 88. As referenced above, any number of staffs 22*a*, 22*b*, 22*c* can be connected to one another by any number of staff unions 24 in order to form a support structure 12 of the desired size. The staff union 24 can be constructed of solid mild steel stock, cold rolled and hot forged.

As discussed above and shown in FIGS. 2 and 3, the first staff 22*a*, staff union 24, and second staff 22*b* generally form an elevational staff section 25*a*, while the third staff 22*c* generally forms a horizontal staff section 25*b*. The elevational staff section 25*a* and the horizontal staff section 25*b* can each respectively include a single staff, or a plurality of staffs connected by one or more staff unions, which allows the elevational and horizontal staff sections 25*a*, 25*b* to be increased or decreased in length based on the vessel that the debris collection apparatus 10 is installed on.

As illustrated in FIGS. 2 and 3, the second staff 22*b* can be connected with the staff union 24 and with the staff cap 26. FIGS. 9A-9D show the staff cap 26 in greater detail. The staff cap 26 includes a staff cap terminal 92 and a universal swivel 20. The staff cap terminal 92 includes a tubular end 94 and a bifurcated end 96. The tubular end 94 is generally circular in shape and is hollow so as to permit the insertion of components such as the staffs 22*a*, 22*b*, 22*c*. The bifurcated end 96 includes a first flange 98, a second flange 100, and a channel 102 defined by the first and second flanges 98, 100. The configuration of the bifurcated end 96 allows the connecting rod 62 of a universal swivel 20 to be inserted into the channel 102 for connection with the staff cap terminal 92. The connecting rod 62 of the universal swivel 20 can be inserted into the channel 102 and connected to the staff cap terminal 92 with a swivel pin 56. Particularly, the swivel pin 56 extends across the first and second flanges 98, 100 and the connecting rod 62 of the universal swivel 20 so that the universal swivel 20 can rotate about the swivel pin 56.

Rotation of the universal swivel 20 is limited by the interruption and impact against the staff cap terminal 92. In some embodiments, this can provide a range of motion for the universal swivel 20 of approximately 270°. Furthermore, the tubular end 94 includes a pre-drilled hole 104 extending therethrough. The hole 104 of the tubular end 94 permits insertion of, for example, the pin 30 in order to engage the staff cap terminal 92 with a staff 22*a*, 22*b*, 22*c*. For example, a second end 76 of the second staff 22*b* can be positioned inside the tubular end 94 of the staff cap terminal 92 with the hole 80 of the second staff 22*b* aligned with the hole 104 of the staff cap terminal 92. Once aligned, a pin 30 can be inserted through the holes 80, 104, thus securing the second staff 22*b* to the staff cap terminal 92. The staff cap terminal 92 can also include a connection loop 108 that can be welded to the side of the staff cap terminal 92 to allow the shroud 14 to be connected thereto. The staff cap terminal 92 can be constructed of mild steel, cold rolled and hot forged. The staff cap terminal 92 can also be formed by welding, for example, a 2¼" diameter solid bar stock with the first and second flanges 98, 100 cut to accept the universal swivel 20 to a pipe having, for example, a 2¼" outer diameter.

The staff cap 26 can be connected with another staff, e.g., the third staff 22*c*, which can be connected to the universal swivel 20 that is rotationally mounted to the staff cap terminal 92. That is, the first end 74 of the third staff 22*c* can be inserted into the head 64 of the universal swivel 20 so that the hole 78 of the third staff 22*c* is aligned with the hole 70 of the universal swivel 20. Once aligned, a pin 30 can be inserted through the holes 70, 78, thus securing the third staff 22*c* to the universal swivel 20. The second end 76 of the third staff 22*c* can then be connected with the stabilizer base 28, described in greater detail below.

FIGS. 10A-10D show the stabilizer base 28 in greater detail. The stabilizer base 28 includes a body 110 and a universal swivel 20. The body 110 includes a bottom 112, a first side 114, and a second side 116, which define a channel 118. This configuration allows for the connecting rod 62 of a universal swivel 20 to be inserted into the channel 118 for connection with the body 110 of the stabilizer base 28. The connecting rod 62 of the universal swivel 20 can be inserted into the channel 118 and connected to the stabilizer base 28 with a swivel pin 56. Particularly, the swivel pin 56 extends from the first side 114 to the second side 116 and across the connecting rod 62 of the universal swivel 20 so that the universal swivel 20 can rotate about the swivel pin 56. Rotation of the universal swivel 20 within the stabilizer base 28 is limited by the interruption and impact against the bottom 112 of the body 110, and can be generally limited to 180°. The universal swivel 20 of the stabilizer base 28 is utilized to connect the third staff 22*c* to the stabilizer base 28 by insertion of the second end 76 of the third staff 22*c* into the head 64 of the universal swivel 20 so that the hole 80 of the third staff 22*c* is aligned with the hole 70 of the universal swivel 20. Once aligned, a pin 30 can be inserted through the holes 70, 80, thus securing the third staff 22*c* to the universal swivel 20. The body 110 of the stabilizer base 28 can be constructed of mild steel that is cold rolled and hot forged. The body 110 of the stabilizer base 28 can also be created from a single sheet of metal, which could be of ⅛" thickness, and formed by cold bending at two points. It should be understood that any other suitable material could be utilized and any other suitable metal forming techniques can be implemented to create the body 110 of the stabilizer base 28.

Figure 11:
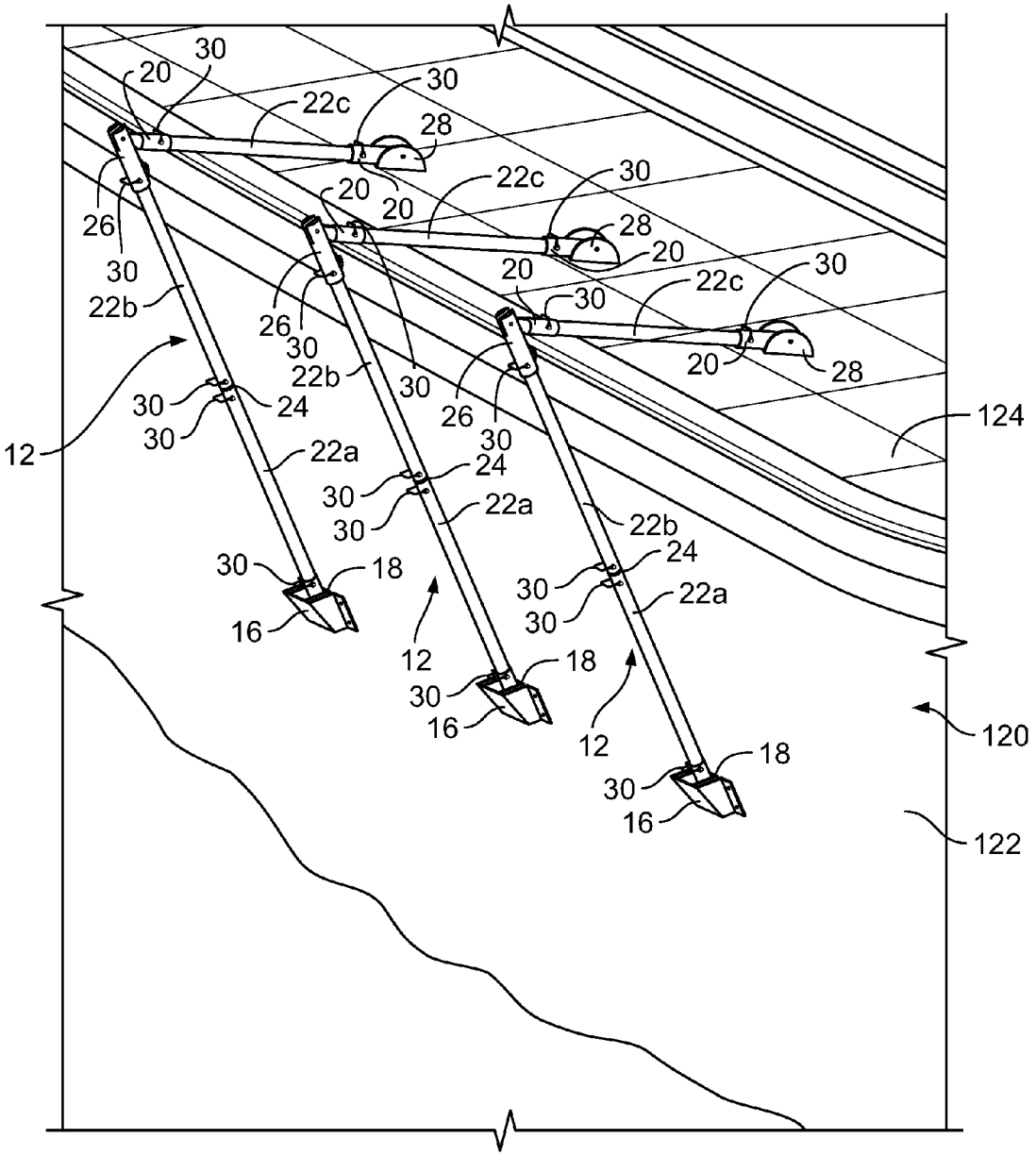
FIG. 11 is a perspective view showing three support structures installed on a vessel to be demolished.
Figure 12:
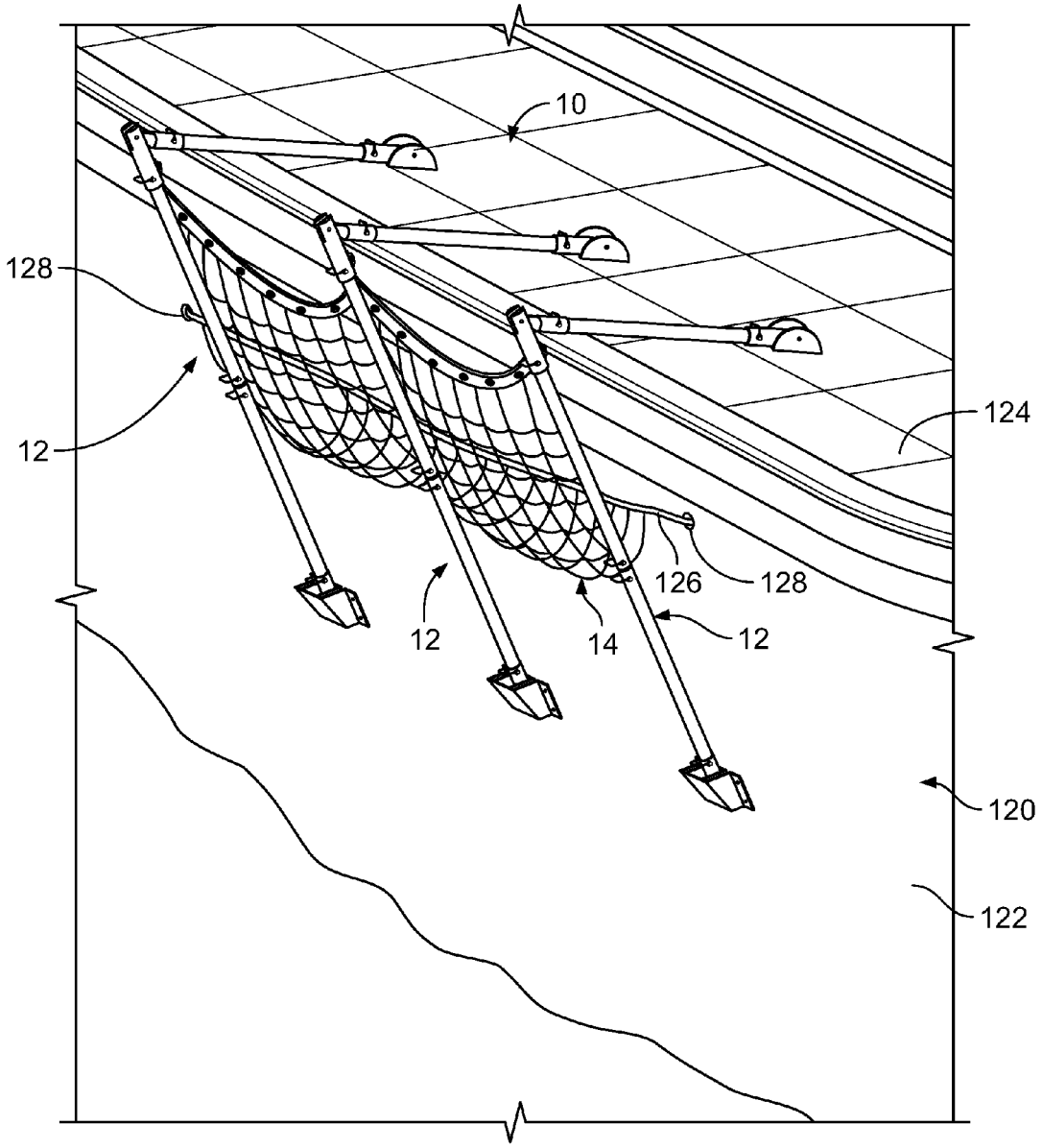
FIG. 12 is a perspective view showing the debris collection apparatus installed on a vessel to be demolished.

FIGS. 11 and 12 generally show an example debris collection apparatus in use. Particularly, FIG. 11 is a perspective view showing three support structures 12 installed on a maritime vessel 120 to be demolished, while FIG. 12 is a perspective view showing the debris collection apparatus 10, including three support structures 12 and a shroud 14 connected to the support structures 12, installed on the maritime vessel 120 to be demolished. In use, the operator obtains a mechanism (e.g., a boat or man lift) to allow access to the maritime vessel 120, and particularly a side 122 of the marine vessel 120, or to a marine structure (not shown) to be protected. The boot 16 is then placed against the side 122 of the marine vessel 120 in a configuration so that the wider portion of the boot 16 is facing a deck 124 of the marine vessel 120 and held in place by a metal-to-metal adhesive. The operator or installer then drills through the pairs of holes 44*a*, 44*b* (see FIGS. 4A-4D) of the boot 16 with a bit that is generally 1/16" smaller than the holes 44*a*, 44*b*. The installer then utilizes a fastener, e.g., self-tapping metal screws, rivets, etc., to permanently attach the boot 16 to the side 122 of the marine vessel 120. The installer then places additional boots 16 along the side 122 of the marine vessel 120 generally installed at approximately 8' intervals around the circumference of the marine vessel 120. Once a sufficient number of boots 16 have been mounted, the installer can install the remaining sections of the support structures 12 from the deck 124 of the marine vessel 120.

Next, the installer connects the first staff 22*a* to the foot 18 as described in detail above. That is, the first staff 22*a* is inserted into the universal swivel 20 of the foot 18, and connected thereto by a pin 30 extending through the hole 78 of the first staff 22*a* and the hole 70 of the universal swivel 20. The installer can then connect as many staffs 22*a*, 22*b*, 22*c* as necessary utilizing staff unions 24, as described in detail above, in order to form the elevational staff section 25*a* and extend the support structure 12 to the elevation necessary to offer protection of the operations being considered.

Once a sufficient elevation has been achieved, the installer then connects the staff cap 26 to the terminal staff 22*a*, 22*b*, 22*c* (for example, the second staff 22*b*, as shown in FIGS. 2, 3, 11, and 12), in the fashion described in detail above. That is, the second staff 22*b* is inserted into the staff cap terminal 92 of the staff cap 26, and connected thereto by a pin 30 extending through the hole 104 of the staff cap terminal 92 and the hole 80 of the second staff 22*b*. Next, the installer connects another staff section, e.g., third staff 22*c*, to the universal swivel 20 of the staff cap 26, as described in detail above, in order to form the horizontal staff section 25*b* that ultimately mounts to the marine vessel deck 124. Specifically, the first end 74 of the third staff 22*c* is inserted into the universal swivel 20 of the staff cap 26, and connected thereto by a pin 30 extending through the hole 78 of the third staff 22*c* and the hole 70 of the universal swivel 20. The second end 76 of the third staff 22*c* is then inserted into the universal swivel 20 of the stabilizer base 28, and connected thereto by a pin 30 extending through the hole 80 of the third staff 22*c* and the hole 70 of the universal swivel 20. In this configuration, the third staff is connected with the stabilizer base 28, and the stabilizer base 28 is linked to the foot 18 by way of the first, second, and third staffs 22*a*, 22*b*, 22*c*, and the staff cap 26.

The stabilizer base 28 is installed on any horizontal surface of the marine vessel 120, e.g., the deck 124 or exposed metal plate of levels or decks that have been exposed during the demolition process. The stabilizer base 28 can be adhered to the deck 124 or exposed metal plate by metal-to-metal adhesive and/or by appropriately sized fasteners (e.g., self-tapping metal screws, rivets, etc.) extending through pilot holes extending through the bottom 112 of the stabilizer base 28. The stabilizer base 28 can be removed from the deck 124 by wedge extraction when the support structure 12 is needed to be moved or disassembled.

The foot 18 of the support structure 12 (e.g., after assembly of the support structure 12) can be inserted into the boot 16, thus securing the support structure 12 to the marine vessel 120 in a mounted and rigid position ready to have the shroud 14 attached. Once all of the support structures 12 are completely mounted to the marine vessel 120 the shroud 14 can be connected to each of the support structures 12 by clipping a portion of the shroud 14 to the connection loop 108 of each staff cap 26 for each of the support structures 12. A shroud tensioner cable 126 can then be thread through a bottom portion of the shroud 14, or, for example, attached to the shroud 14 with carabiners or slip loops engaging grommets thereof, and inserted into two appropriately sized holes 128 formed in (e.g., drilled or cut through) the side 122 of the marine vessel 120 or in an area of sufficiently lower elevation to form a cup into which debris and contaminants are collected. That is, during demolition of the maritime vessel 120, any debris or contaminants that happen to fall overboard will be caught by the debris collection apparatus 10, and trapped in the shroud 14, so that they do not fall into the adjacent waterway or onto an adjacent marine structure, e.g., dock, pier, warf, etc. It should be understood by one of ordinary skill in the art that the shroud 14 can be a mesh net, welding blanket, or any other known shroud device.

Once demolition is complete, or at any intermediate time if desired, the debris collection apparatus 10 can be disassembled and removed. Specifically, the shroud 14 can be detached from the support structures 12, and each of the support structures 12 can be disassembled whereby the foot 18 can be removed from the boot 16, and each of the foot 18, universal swivels 20, staffs 22*a*, 22*b*, 22*c*, staff unions 24, staff cap 26, and stabilizer base 28 can be detached from one another by removing the pins 30 that connect each adjacent component. Once the support structures 12 are disassembled, the boot 16 and the stabilizer base 28 can be removed from the maritime vessel 120 by removing the implemented fasteners and through wedge extraction. The debris collection apparatus 10 can then be reused at another demolition site.

Accordingly, the present disclosure provides a new debris and contaminant support structure that can be utilized on any type of ship during a demolition process, or on any other fixed or floating maritime structure, regardless of confirmation, design, or construction materials. Furthermore, the present disclosure can be utilized in conjunction with a variety of other commercially available components, e.g., shroud systems, to protect inadvertent marine contamination.

Additionally, and in accordance with the above description, the present disclosure provides an environmental control system including structural supports for protective shrouds to protect the waterways from inadvertent contamination by debris and scree (torch residue from cutting operations) that may result from cutting and demolition operations upon ships moored to piers. Thus, the present disclosure satisfies concerns for human health, solid emissions, and safety by providing the ability to prevent scree, exfoliating lead-based paint, slag (molten metal debris), and heavy objects (upwards of 600 pounds) from inadvertently falling into the waterways in areas where the debris collection apparatus 10 of the present disclosure is installed.

It will be understood that the embodiments of the present disclosure described herein are merely exemplary and that a person skilled in the art may make many variations and modifications without departing from the spirit and the scope of the invention. All such variations and modifications, including those discussed above, are intended to be included within the scope of the invention as defined by the appended claims.

What is claimed is:

1. A debris collection apparatus for a maritime vessel, comprising:

a shroud for containing debris; and a plurality of support structures, at least including a first and a second support structure, wherein each of the plurality of supports structures comprises:

a boot defining a cavity, the boot being configured to be removably secured to the maritime vessel;

a foot including a frame and a first universal swivel rotatably mounted to the frame, the foot being sized to fit within the cavity of the boot;

a staff cap including a staff cap terminal and a second universal swivel rotatably mounted to the staff cap terminal;

a stabilizer base including a body and a third universal swivel rotatably mounted to the body, the stabilizer base being configured to be removably secured to the maritime vessel;

an elevational staff section removably connected to the first universal swivel and the staff cap terminal; and a horizontal staff section removably connected to the second universal swivel and the third universal swivel;

wherein the foot is inserted into the boot to secure the first and second support structures in a rigid position, and the shroud is connected to the staff cap of the first support structure, the staff cap of the second support structure, and the vessel to collect debris.

2. The debris collection apparatus of claim 1, wherein the plurality of support structures includes a third support structure having a staff cap, the shroud being further connected to the staff cap of the third support structure.

3. The debris collection apparatus of claim 1, wherein the elevational staff section includes at least two staffs connected by at least one staff union.

4. The debris collection apparatus of claim 1, wherein the horizontal staff section includes at least two staffs connected by at least one staff union.

5. The debris collection apparatus of claim 1, wherein the foot includes a stop pin that restricts rotation of the first universal swivel.

6. The debris collection apparatus of claim 1, wherein the staff cap terminal restricts rotation of the second universal swivel.

7. The debris collection apparatus of claim 1, wherein the shroud is one of a mesh net and a welding blanket.

8. The debris collection apparatus of claim 1, wherein the boot is secured to a side of the maritime vessel and the stabilizer base is secured to a deck of the maritime vessel.

9. The debris collection apparatus of claim 1, wherein the elevational staff section is removably connected to the first universal swivel and the staff cap terminal by removable pins, and the horizontal staff section is removably connected to the second universal swivel and the third universal swivel by removable pins.

10. The debris collection apparatus of claim 9, wherein the first and second support structures can be deconstructed by removing the foot from the boot, removing the removable pins, and disconnecting the first universal swivel of the foot, the elevational staff section, the second universal swivel of the staff cap, the horizontal staff section, and the third universal swivel of the stabilizer base.

11. The debris collection apparatus of claim 1, wherein the shroud includes a tensioner cable that can be connected to the maritime vessel and tightened to secure the shroud to the maritime vessel.

12. A portable support structure kit for a debris collection apparatus used to collect debris during demolition of a maritime vessel, comprising:

a boot defining a cavity, the boot being removably securable to the maritime vessel;

a foot including a frame and a first universal swivel rotatably mountable to the frame, the foot being sized to fit within the cavity of the boot;

a staff cap including a staff cap terminal and a second universal swivel rotatably mountable to the staff cap terminal;

a stabilizer base including a body and a third universal swivel rotatably mountable to the body, the stabilizer base being removably securable to the maritime vessel;

an elevational staff section removably connectable to the first universal swivel and the staff cap terminal; and a horizontal staff section removably connectable to the second universal swivel and the third universal swivel;

wherein the foot is insertable into the boot to secure the first and second support structures in a rigid position.

13. The portable support structure kit of claim 12, wherein the elevational staff section includes at least two staffs connectable by at least one staff union.

14. The portable support structure kit of claim 12, wherein the horizontal staff section includes at least two staffs connectable by at least one staff union.

15. The portable support structure kit of claim 12, wherein the foot includes a stop pin that restricts rotation of the first universal swivel.

16. The portable support structure kit of claim 12, wherein the staff cap terminal restricts rotation of the second universal swivel.

17. The portable support structure kit of claim 12, wherein the elevational staff section is removably connectable to the first universal swivel and the staff cap terminal by removable pins, and the horizontal staff section is removably connectable to the second universal swivel and the third universal swivel by removable pins.

18. The portable support structure kit of claim 17, wherein the first and second support structures are deconstructable by removing the foot from the boot, removing the removable pins, and disconnecting the first universal swivel of the foot, the elevational staff section, the second universal swivel of the staff cap, the horizontal staff section, and the third universal swivel of the stabilizer base.

19. A method of installing a support structure on a maritime vessel, comprising:

securing a boot to the maritime vessel, the boot defining a cavity;

removably connecting an elevational staff section to a foot by removably engaging the elevational staff section with a first universal swivel of the foot, the foot being sized to fit within the cavity of the boot and further including a frame having the first universal swivel mounted thereto;

removably connecting the elevational staff section to a staff cap by removably engaging the elevational staff section with a staff cap terminal of the staff cap, the staff cap further including a second universal swivel rotatably mounted to the staff cap terminal;

removably connecting a horizontal staff section to the staff cap by removably engaging the horizontal staff section with the second universal swivel of the staff cap;

removably securing a stabilizer base to the maritime vessel, the stabilizer base including a body and a third universal swivel rotatably mounted to the body;

removably connecting the horizontal staff section to the third universal swivel of the stabilizer base; and inserting the foot into the boot.

* * * * *